US006695420B2

(12) United States Patent
Ackerman

(10) Patent No.: US 6,695,420 B2
(45) Date of Patent: Feb. 24, 2004

(54) SYSTEM AND METHOD FOR ATTACHING A DRAWER FACE

(76) Inventor: Tracy Edgar Ackerman, 2407 Warwick La., Colorado Springs, CO (US) 80909

( * ) Notice: Subject to any disclaimer, the term of this patent is extended or adjusted under 35 U.S.C. 154(b) by 0 days.

(21) Appl. No.: 10/022,354

(22) Filed: Dec. 12, 2001

(65) Prior Publication Data

US 2002/0112781 A1 Aug. 22, 2002

Related U.S. Application Data

(60) Provisional application No. 60/255,361, filed on Dec. 13, 2000.

(51) Int. Cl.[7] ..... A47R 88/04
(52) U.S. Cl. ..... 312/348.4; 312/265.5
(58) Field of Search ..... 312/348.1, 348.2, 312/348.3, 348.4, 348.5, 348.6, 263, 265.5, 265.6

(56) References Cited

U.S. PATENT DOCUMENTS 2,498,139 A * 2/1950 Simjian ..... 248/467
3,612,639 A * 10/1971 Williams ..... 312/310
3,933,402 A * 1/1976 Peterson ..... 312/265.1
4,586,762 A * 5/1986 Kennedy et al. ..... 312/330.1
4,850,502 A * 7/1989 Davis ..... 220/759
5,152,593 A * 10/1992 Domenig ..... 312/245
5,282,542 A * 2/1994 Mo ..... 220/7
5,597,221 A * 1/1997 Grieser et al. ..... 312/348.1
5,931,551 A * 8/1999 Wang ..... 312/258
5,979,337 A * 11/1999 Clark et al. ..... 108/43
6,428,129 B1 * 8/2002 Chen ..... 312/348.1

* cited by examiner

*Primary Examiner*—Janet M. Wilkens
(74) *Attorney, Agent, or Firm*—Law Office of Dale B. Halling, LLC

(57) ABSTRACT

A system for attaching a drawer face includes a fixture capable of attaching to a drawer box. The fixture has a surface that is substantially planar to a surface of the drawer box. A semi-permanent attachment device is capable of connecting the surface of the fixture to the drawer face. This system holds the drawer face in place while the carpenter screws the drawer face to the drawer box.

12 Claims, 2 Drawing Sheets

SYSTEM AND METHOD FOR ATTACHING A DRAWER FACE

RELATED APPLICATIONS

This patent claims priority from the provisional patent application filed on Dec. 13, 2000 having application Ser. No. 60/255,361, entitled "Face Saver".

FIELD OF THE INVENTION

The present invention relates generally to the field of woodworking and more particularly to a system and method for attaching a drawer face.

BACKGROUND OF THE INVENTION

Attaching and aligning drawer faces is a time consuming and tedious process in the cabinetry industry. One solution has been to clamp the drawer face to the drawer box and then drive screws into the drawer face through a side of the drawer box. This commonly results in the drawer face being misaligned or not level. In addition, the drawer face may be marred by the clamp. Another solution has been to use the BLOOM® drawer front adjuster. These devices require the carpenter to drill ¾ inch diameter plug about ½ inch deep into the back of the drawer face. The worker then pounds a plastic plug into the hole in the drawer face. The plastic plug has a center void with a nut. The worker drills a hole in the drawer box and attaches a screw through the hole and into the nut. A number of problems may occur in attempting to use this solution. The worker may accidentally drill a hole all the way through the drawer face. Thus destroying a drawer face. The plastic plug may break when pounded in to the drawer face, requiring the worker to spend time removing the plug. In addition, to these problems the process of using plugs is slow.

Thus there exists a need for a system and method for attaching a drawer face that is easy to use, adjustable and can be completed quickly.

SUMMARY OF THE INVENTION

A system for attaching a drawer face includes a fixture capable of attaching to a drawer box. The fixture has a surface that is substantially planar to a surface of the drawer box. A semi-permanent attachment device is capable of connecting the surface of the fixture to the drawer face. This system holds the drawer face in place while the carpenter screws the drawer face to the drawer box. The system provide a quick, reliable and easy to use method of attaching drawer faces.

DETAILED DESCRIPTION OF THE DRAWINGS

Figure 1:
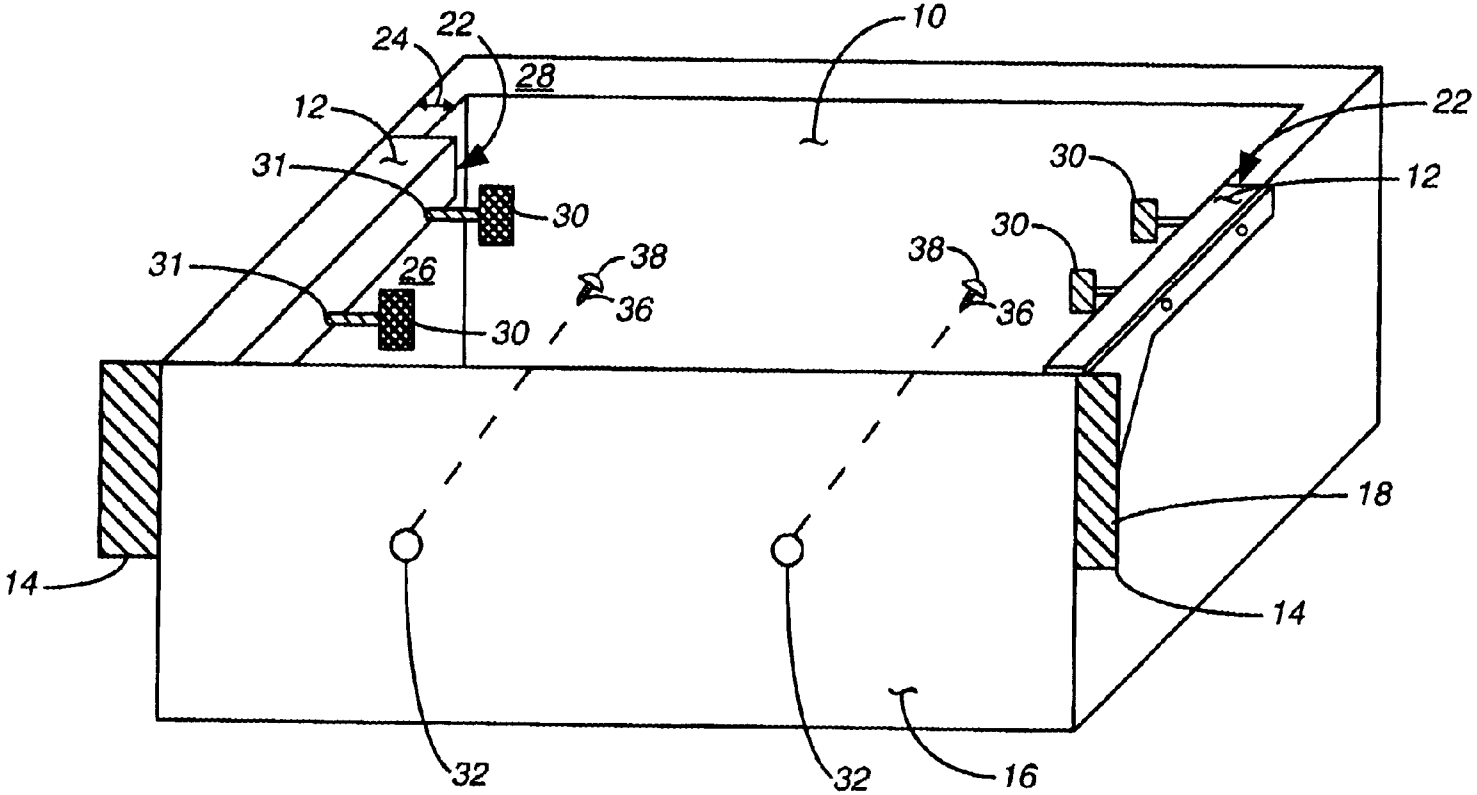
FIG. 1 is a perspective view of a drawer box with a pair of fixtures in accordance with one embodiment of the invention.

The system of the present invention is designed to substantially reduce the time and effort required to attach a drawer face to a drawer box. The system is designed to allow for minor adjustments in the placement of the drawer face. By simplifying and speeding up this process, the system saves money. FIG. 1 is a perspective view of a drawer box

10 with a pair of fixtures 12 in accordance with one embodiment of the invention. The fixtures 12 have a surface 14 that is placed substantially planar with a surface 16 of the drawer box 10. A semi-permanent attachment device 18 is attached to the surface 14. In one embodiment, the semi-permanent attachment device 18 is a first portion of a hook and loop material (commonly known as VELCRO®). Usually one side of the hook and loop material has an adhesive that attaches to the surface 14 of the fixture 12. The second portion of the hook and loop material is placed on the first portion and the adhesive backing removed. When the carpenter places the drawer face 20 (see FIG. 2) against the fixture 12 the adhesive on the second portion attaches to the backside of the drawer face 20. This provides a semi-permanent attachment between the fixture 12 and the drawer face 20. Other semi-permanent attachment devices may also be used such as a semi-permanent adhesive. However, the hook and loop material provides additional benefits. For instance, the second portion of the hook and loop material is commonly left on the drawer face and provides a bumper effect for the drawer.

The fixture 12 has a channel 22 that is substantially U shaped. The channel 22 is larger than the width 24 of a side 26 of the drawer box 10. The fixture 12 is secured to the side 26 of the drawer box 10 by placing the channel 22 over the edge 28 of the drawer box 10. Then a screw knob or knobs 30 are tightened to hold the fixture 12 in place. The screw knobs 30 screw into a threaded opening 31 in the fixture 12. Note that other attachment means may be used. For instances, a metal spring may be used to hold the fixtures in place. The fixtures 12 are adjusted so that the surface 14 is substantially planar with the surface 16 of the drawer box.

Figure 2:
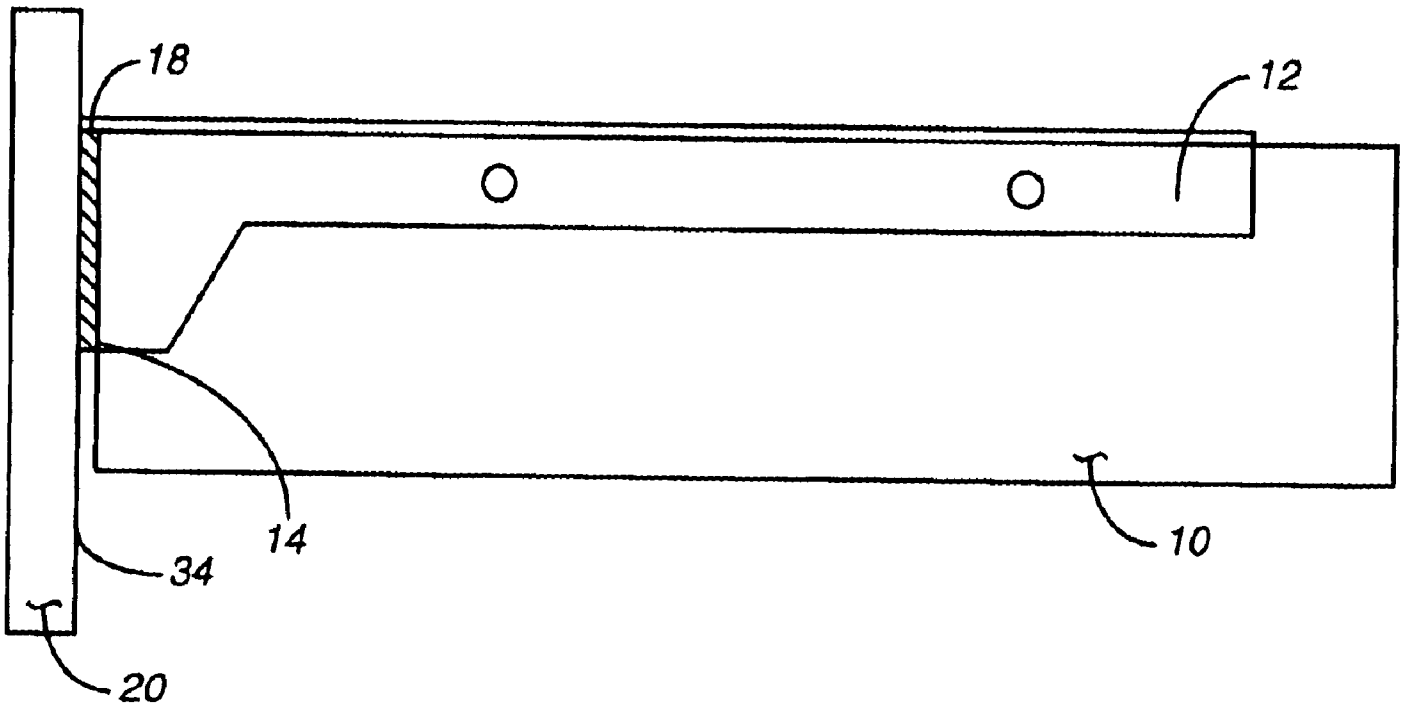
FIG. 2 is a side view of a drawer box with a fixture holding a drawer face in accordance with one embodiment of the invention.

FIG. 2 is a side view of a drawer box 10 with a fixture 12 holding a drawer face 20 in accordance with one embodiment of the invention. Once the fixture 12 is attached to the drawer box 10 the carpenter may place the drawer face 20 against the drawer box 10. The hook and loop material 18 then provides a semi-permanent attachment of the drawer face 20 to the fixture 12.

The recommend procedure for using the system is to drill a pair of holes 32 in the surface 16 of the drawer box 10 to be attached to the drawer face 20. Ideally the holes 32 are slightly larger than the screws that will be used to hold the drawer face 20. This allows for adjustment of the drawer face 20. Next the pair of fixtures 12 are placed over the edges 28 of the sides 26 of the drawer box 10. The fixtures 12 are aligned so that the surfaces 14 are substantially planar with the surface 16 that will abut the drawer face 20. The screw knobs 30 are finger tightened to hold the fixtures 12 in place. Note that the fixtures 12 will generally come with the first portion of the hook and loop material attached to the surface 14 of the fixture 12. Next the carpenter attaches the second portion of the hook and loop material to the first portion. Then he removes the backing from the second portion of the hook and loop material. Next he positions the drawer face in the desired position and the adhesive on the second portion attaches to the the backside 34 of the drawer face 20. The hook and loop material 18 holds the drawer face while the carpenter drives screws through the holes 32 into the drawer face 20. The screws 36, in one embodiment, have a large head 38. This helps to facilitate the adjustment of the drawer face 20. In addition, the screws 38 should have a length that allows them to be tightened without extending through the drawer face 20. The fixtures 20 are then removed by loosening the screw knobs 30. Any adjustments in the drawer face may be implemented at this time. The hook and loop material on the backside 34 of the drawer face 20 may be left in place to provide a bumper for the drawer.

Thus there has been described a simple system and method for attaching a drawer face to a drawer box. Tests have shown that this system and method reduces the time to place a drawer face on a drawer box in half compared to prior art methods. In addition, the present invention reduces the number of errors associated with prior art systems.

While the invention has been described in conjunction with specific embodiments thereof, it is evident that many alterations, modifications, and variations will be apparent to those skilled in the art in light of the foregoing description. Accordingly, it is intended to embrace all such alterations, modifications, and variations in the appended claims.

What is claimed is:

1. A system for attaching a drawer face comprising:

a fixture capable of temporarily attaching to a drawer box, the fixture having a surface that is substantially planar to a surface of the drawer box; and a semi-permanent attachment device capable of connecting the surface of the fixture to the drawer face wherein the fixture is removed from the drawer box once the drawer face is attached drawer box and the semi-permanent attachment device contains a first portion and a second portion.

2. The system of claim 1, wherein the first portion is a hook material and the second portion is a loop material.

3. The system of claim 2, wherein the second portion is attached by an adhesive to a surface of the drawer face.

4. The system of claim 1, wherein the first portion is attached by an adhesive to the surface of the fixture.

5. The system of claim 1, wherein the fixture includes a channel that fits over a side of a drawer box.

6. The system of claim 1, wherein the fixture has a threaded opening.

7. The system of claim 6, further including a screw knob.

8. A method of attaching a drawer face, comprising the steps of:

a) attaching a pair of fixtures to a drawer box;

b) attaching a side of a hook and loop material to the fixture;

c) placing the drawer face in a desired position, wherein the drawer face has a second side of the hook and loop material; and d) driving a pair of screws through the drawer box into the drawer face.

9. The method of claim 8 wherein step (a) further includes the steps of:

a1) drilling a pair of holes through a side of the drawer box.

10. The method of claim 8, further including the step of:

e) removing the fixtures.

11. The method of claim 8 wherein step (a) further includes the step of:

a1) attaching the side of a hook and loop material to a surface on each of the pair of fixtures.

12. The method of claim 8, wherein step (a) further includes the step of:

a1) tightening a screw knob on each of the pair of fixtures.

* * * * *